United States Patent [19]

Vincoli

[11] Patent Number: 4,607,504

[45] Date of Patent: Aug. 26, 1986

[54] NEEDLE DIAL FOR A SINGLE-CYLINDER CIRCULAR HOSIERY KNITTING MACHINE FOR PRODUCING RIBBED KNITTING

[75] Inventor: Armando Vincoli, Brescia, Italy

[73] Assignee: Santoni & C. S.p.A., Brescia, Italy

[21] Appl. No.: 611,092

[22] Filed: May 17, 1984

[30] Foreign Application Priority Data

May 31, 1983 [IT] Italy ..... 22001/83[U]

[51] Int. Cl.[4] ..... D04B 9/22; D04B 15/18

[52] U.S. Cl. ..... 66/24; 66/115

[58] Field of Search ..... 66/24, 95, 115

[56] References Cited

U.S. PATENT DOCUMENTS

| | | | |
|---|---|---|---|
| 1,418,345 | 6/1922 | Witherell | 66/95 |
| 2,401,083 | 5/1946 | Koppel | 66/115 |
| 2,626,515 | 1/1953 | St. Pierre | 66/95 |
| 3,545,233 | 12/1970 | Lombardi | 66/115 X |
| 4,041,734 | 8/1977 | Yoichi | 66/115 |

FOREIGN PATENT DOCUMENTS

| | | | |
|---|---|---|---|
| 20006 | of 1898 | United Kingdom | 66/95 |

*Primary Examiner*—Wm. Carter Reynolds

*Attorney, Agent, or Firm*—Diller, Ramik & Wight

[57] ABSTRACT

A needle dial for single-cylinder circular hosiery knitting machines for producing ribbed knitting includes a disc having a plurality of radially extending angularly equidistantly spaced dividing walls. Each adjacent pair of dividing walls sets-off therebetween a radially extending groove, and each groove is defined by a bottom wall of the disc and one wall each of adjacent pairs of the dividing walls. The one walls have upper wall portions in generally spaced parallel relationship to each other and to a longitudinal axis of the groove defined thereby. A lower radially outermost wall portion of one of each of the one walls defining each groove is circumferentially off-set from a radially innermost wall portion thereof and from its associated longitudinal axis thereby being adapted to receive therein a distal arch of an associated composite needle. An annular downwardly opening cavity in each dividing wall immediately of radially opposite ends thereof is adapted to be closed by a lower element secured to the disc through associated abutment step portions of the lower element and the disc.

8 Claims, 3 Drawing Figures

NEEDLE DIAL FOR A SINGLE-CYLINDER CIRCULAR HOSIERY KNITTING MACHINE FOR PRODUCING RIBBED KNITTING

This invention relates to an improved needle dial for a single-cylinder circular hosiery knitting machine for producing ribbed knitting.

Circular hosiery knitting machines for producing ribbed knitting are provided not only with vertical needles or cylinder needles, but also with a second set of needles disposed in horizontal radial slots or grooves in a dial overlying the cylinder and rotating synchronously with it. The needles of this second set are therefore called horizontal needles or dial needles.

The cylinder needles are required to form the plain stitch rows of the knitted fabric, whereas the dial needles form the purl stitch rows.

In these machines for producing ribbed knitting, one of the most delicate and critical stages is known to be the transfer of the stitches from the dial needles to the cylinder needles. This is because the pairs of dial and cylinder needles have to be crossed-over in order to effect this transfer. Various special composite dial needles have been proposed for facilitating this cross-over. One known type of composite needle comprises a flexible element in the form of a leaf spring fixed rigidly to the side of the dial needle shank, which is provided with a cavity for the passage of the relative cylinder needle during the stitch transfer. Said leaf spring extends from the fixing zone to slightly beyond said cavity in the side of the needle, and forms at said cavity a sort of arch opposite the cavity itself, so as to create an eye having a width greater than the thickness of the needle.

Another type of composite dial needle, recently proposed by the present applicant, comprises not only the actual needle, which is provided with a drive butt and has a cavity formed in one side of its shank, but also a flexible element in the form of a separate jack which is disposed alongside the actual needle but is not joined to it, said jack comprising a distal arch opposite said cavity to form an eye therewith, and being provided with its own drive butt corresponding to that of the actual needle.

Both these types of composite dial needle enable the reliablity and precision of the stitch transfer in circular machines for ribbed knitting production to be substantially improved. This is because the presence of said eye not only keeps the stitch loop already constructed on the dial needle more opened out, but also allows the loop to be more reliably taken up by the cyclinder needle in that any mutual alignment inaccuracies between the dial needles and cylinder needles are absorbed by the width of the eye, into which the head of the upwardly rising cylinder needle is inserted and which tolerates these inaccuracies, so resulting in an always perfect stitch transfer.

However, it has been found that the presence of said eye, which is formed partly by the distal arch of the flexible element cooperating with the actual needle, can give rise to a further drawback. In this respect, during the radial movements of the dial needle with its flexible element in the corresponding slot or groove of the needle dial, the flexible element is subjected to continuous bending stress at its distal arch. When the needle returns towards the centre of the dial, the flexible element is compelled to bear against the needle and its distal arch becomes flattened against the needle. With the passage of time, the flexible element can thus undergo fatigue fracture.

The object of the present invention is therefore to provide a needle dial which obviates this drawback by preventing the composite dial needles becoming subjected to fatigue stress, thus enabling the advantages of these types of needle to be completely exploited. This object is attained according to the invention by a needle dial comprising a disc rigid with a hub for its fixing to a rotating shaft, in said disc there being provided angularly equidistant raidal grooves closed at their base and open upwards, said grooves opening freely at the periphery of the disc and being arranged to each receive a composite needle provided with a flexible element forming a distal arch, the needle dial being characterised in that each groove formed in said disc comprises, starting from its peripheral opening, a widened portion for freely receiving the distal arch of the flexible element of the composite needle.

This initial widened portion of each guide groove for the composite needle has to be able to receive the distal arch of the relative flexible element during the entire radial excursion of said needle, so that said flexible element does not undergo the continuous alternating stresses caused by the compression and relaxation of its distal arch, as happens in the case of a guide groove of constant width, any fatigue fracture of said flexible element thus being prevented.

Advantageously, the widening of the initial portion of the guide groove is non-symmetrical about the central axial plane through the groove, the widening being on the same side as the distal arch of the flexible element associated with the needle.

In a particularly advantageous embodiment, the needle dial according to the present invention comprises a disc in which the radial guide grooves for the composite needles are provided, the base of the disc comprising a downwardly open annular cavity closed by a corresponding annular element fixed lowerly to the disc.

This specific embodiment of the needle dial facilitates the practical construction of the widened portions of the individual grooves, in that these widened portions need be formed only to a peripheral band of the disc, to then open into said lower annular cavity. In this respect, it would be rather difficult to widen-out the grooves with the necessary accuracy over the entire length required by the excursion of the distal arch of the flexible element in the relative groove, and it was therefore decided to remove an annular band from the base of the disc, to widen the grooves only in the remaining peripheral annular band, and to then close the base of the disc with an added element in order to restore the continuity of the closed base of the guide grooves.

Preferably, in this latter embodiment of the needle dial according to the invention, a first operation is carried out in which dead bores of limited length are formed radially starting from the disc periphery, this being followed by an operation in which the annular cavity is formed in the base of the disc by turning, this annular cavity having an outer diameter such that the previously formed radial bores open into said cavity.

The lower annular cavity formed in the disc, to be then closed lowerly by said added annular element, must have a depth such that the dividing walls between the various radial grooves, in the annular band corresponding to the cavity, remain suitably spaced from the base of the grooves when this base is restored by said added element. In this manner, in the assembled plate there is created a free annular interspace into which said radial peripheral widening bores for the guide channels open internally, and which thus extends these bores over the length necessary to receive, without compressing them, the arches of the flexible elements of the composite needles during their entire radial excursion, but without prejudicing perfect guiding of the composite needles.

The invention is described in detail hereinafter with reference to the accompanying drawings, in which.

Figure 1:
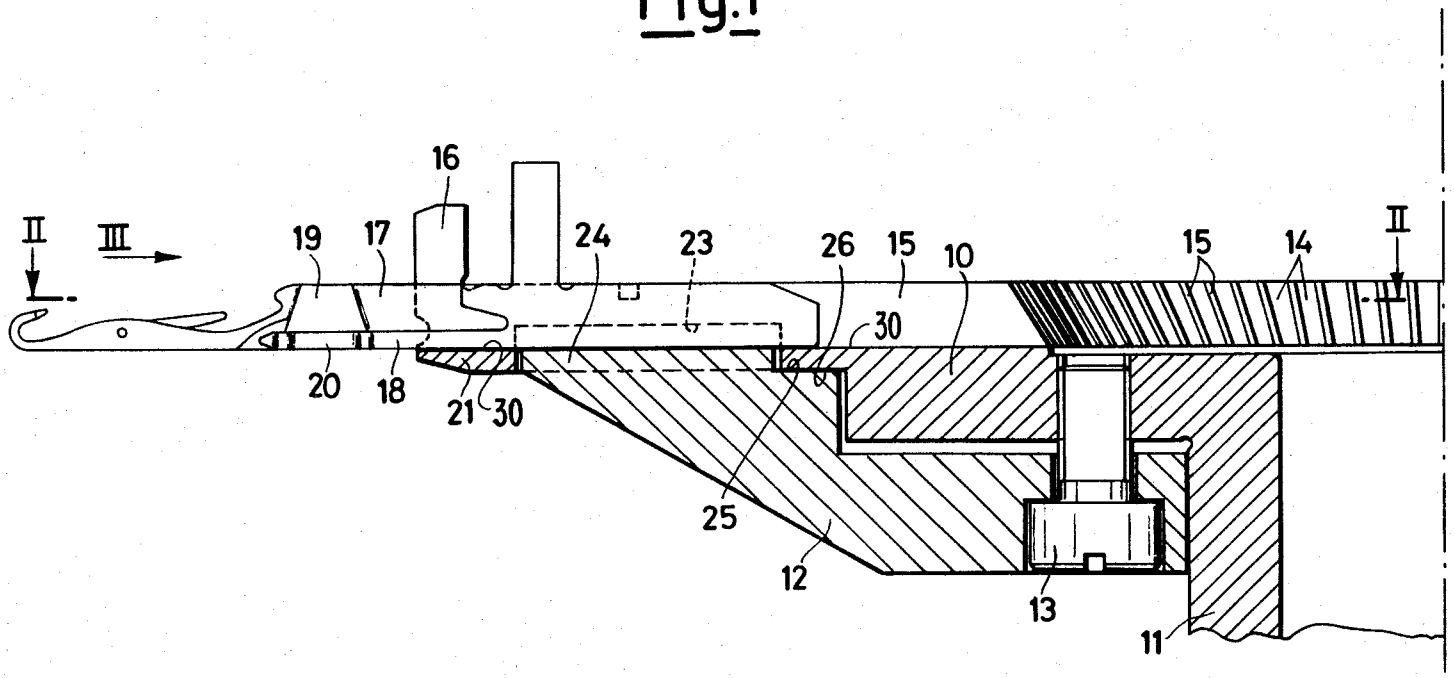
FIG. 1 is a vertical section through one half of the needle dial on the line I—I of FIG. 2.

The needle dial shown on the drawings is composed of a disc 10 formed in a single piece with the hub 11, and a lower added element 12 which can be fixed to the disc 10 by screws, of which one, 13, is shown in FIG. 1.

Figure 2:
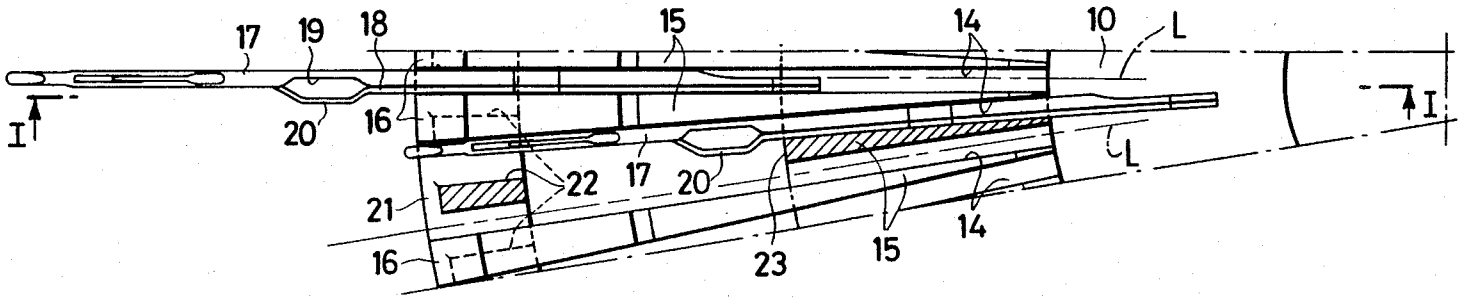
FIG. 2 is a horizontal section through the dial generally on the line II—II of FIG. 1.

In particular, in the upper part of the disc 10 there are provided radial grooves 14, between which there remain dividing walls 15. The grooves 14 are of constant width, each has a longitudinal axis (L, FIG. 2) a closed base, and are open upperly, whereas the dividing walls 15 have a thickness which reduces towards the centre starting from a maximum value at the periphery of the disc 10. The grooves 14 open freely at the disc periphery, and between which in this zone there are formed raised teeth 16.

Into each groove 14 there is inserted a composite needle comprising an actual latch needle 17 and a flexible element 18 disposed alongside it, this latter in the illustrated case being independent of the actual needle. The needles 17 and flexible elements 18 upperly comprise drive butts against which fixed cams (not shown) act in order to cause the pairs formed by the needles and relative flexible elements to undergo radial movements, in the manner known in the art, during the rotation of the disc 10 (which is fixed by means of the hub 11 to a rotating vertical shaft, not shown).

It should be noted that the relative flexible element 18 disposed alongside each needle could in fact also be fixed to it. Each needle 17 is provided on one side of its shank with a cavity 19, and the relative flexible element 18 comprises a distal arch 20 facing said cavity in such a manner as to form an eye.

Figure 3:
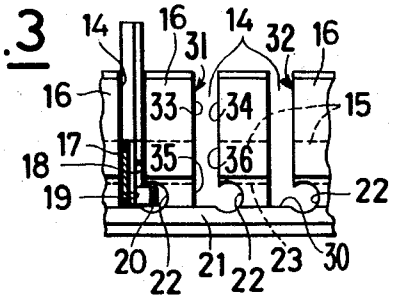
FIG. 3 is an outer view of a limited sector of the dial in the direction of the arrow III of FIG. 1.

In order to prevent the arch 20 of the flexible element 18 undergoing alternate relaxation and flattening compression stages during each outward and return movement of the composite needle 17–18 in the relative groove 14 of the disc 10, and which could cause premature fatigue fracture of the flexible element itself, according to the invention that groove portion occupied by said arch during its movement is suitably widened. Each groove 14 is set-off by a top wall 30 of the disc 20 and one wall 31, 32 of adjacent pairs of the dividing walls 15. The walls 31, 32 have respective upper wall portions 33, 34 and respective lower wall portions 35, 36, the latter of which is partially circumferentially off-set from the longitudinal axis (L) and from a radially innermost wall portion (37) thereof to define a lower radially outermost wall portion, bore or recess 22. The bore or recess 22 has its axis displaced towards that side of the central axial plane or longitudinal axis (L). Through the groove 14 from which the arch 20 projects from the composite needle 17–18, as clearly shown in FIGS. 2 and 3. Said bore 22 opens externally at the periphery of the disc 10, as does the relative groove 14, and is able to receive, without compressing it, the arch 20 of the flexible element 18 of the composite needle 17–18 which is inserted into the groove 14. On its lower side, the disc 10 comprises an annular cavity 23 which follows the annular peripheral band 21 towards the centre, and the base of the radial grooves 14 is interrupted at this annular cavity 23. Consequently, said radial bores 22 open internally into said annular cavity 23, which thus extends the radial widening bores 22 for the grooves 14 towards the centre of the disc 10. The depth of the annular cavity 23 corresponds to the height of the flexible elements 18 disposed alongside the needles 17, so that the arch 20 formed in the flexible elements 18 can also be contained in the annular cavity 23 without undergoing compression, in the same manner as in the radial bores 22. This is because the annular cavity 23 removes not only the base of the grooves 14, but also the lower zones of the dividing walls 15.

In order to restore the interrupted base of the grooves 14 and avoid any discontinuity in the support for the composite needles 17–18, to the lower side of the disc 10 is fixed the added element 12, in such a manner that its annular band 24 is partly inserted into the annular cavity 23 of the disc 10. The upper surface of the annular band 24 of the added element 12 is perfectly coplanar with the support base of the grooves 14 (see FIG. 1), and this coplanarity is ensured by the fact that an annular step 25 on the element 12 rests against a corresponding annular step 26 formed on the underside of the disc 10.

The embodiment illustrated on the drawings and described heretofore is particularly advantageous in that it overcomes the difficulty involved in forming, with the necessary accuracy, widening bores starting from the periphery of the disc and extending through a length sufficient to receive the arches of the flexible elements associated with the needles over the entire radial excursion of these members, without subjecting the arches to compression.

In this respect, in the preferred embodiment, said widening bores 22 are of limited length and can be formed with maximum precision. In practice, a first operation is carried out in which dead-ended bores are formed starting from the disc periphery, followed by subsequent operations in which the radial grooves and lower annular cavity are formed in the disc, these being operations which are not particularly difficult to carry out.

Fixing the lower added element thus completes the dial by restoring continuity of the support for the composite needles in the relative grooves. When the plate is assembled in this manner, a free interspace is created between the upper surface of the annular band of the added element partly inserted into the lower annular cavity of the disc, and the plane constituted by the lower edges of the dividing walls between the grooves.

The radial peripheral widening bores for the grooves open internally into this interspace, so that during the radial movements of the composite needles, which remain perfectly guided in the relative grooves, the distal arches of the flexible elements undergo no compression at all, and are not subjected to continuous stresses which could lead to fatigue fracture.

I claim:

1. A needle dial for single-cylinder circular hosiery knitting machines for producing ribbed knitting comprising a disc having a plurality of radially extending angularly equidistantly spaced dividing walls, each adjacent pair of dividing walls setting-off therebetween a radially extending groove, each groove being defined by a top wall of said disc and one wall each of adjacent pairs of said dividing walls, said one walls having upper wall portions in generally spaced parallel relationship to each other and to a longitudinal axis of the groove defined therebetween, a lower radially outermost wall portion of one of said one walls being circumferentially offset from a radially innermost wall portion thereof and from its associated longitudinal axis thereby forming a recess adapted to receive therein a distal arch of an associated composite needle, an annular downwardly opening cavity in each dividing wall medially of radially opposite ends thereof, each recess being in radial communication with said annular cavity, a lower element removably secured to said disc, said lower element having an annular band bridging each cavity, and said annular band having an upper surface generally coplanar with said grooves bottom walls.

2. The needle dial as defined in claim 1 including a latch needle and an associated flexible element positioned in at least selected ones of said grooves, each flexible element having a distal arch, each flexible element being of a predetermined height, and each annular cavity having a height generally coresponding to said predetermined height.

3. The needle dial as defined in claim 1 including cooperative abutment steps formed by portions of said disc and said lower element for accurately locating said annular band relative to said cavities.

4. The needle dial as defined in claim 1 wherein each lower radially outermost circumferentially offset wall portion recess is defined by a generally radial bore opening into an associated one of said grooves.

5. The needle dial as defined in claim 2 wherein each lower radially outermost circumferentially offset wall portion recess is defined by a generally radial bore opening into an associated one of said grooves.

6. The needle dial as defined in claim 3 wherein each lower radially outermost circumferentially offset wall portion recess is defined by a generally radial bore opening into an associated one of said grooves.

7. The needle dial as defined in claim 4 including a latch needle and an associated flexible element positioned in at least selected ones of said grooves, each flexible element having a distal arch, each flexible element being of a predetermined height, and each annular cavity having a height generally corresponding to said predetermined height.

8. The needle dial as defined in claim 4 including cooperative abutment steps formed by portions of said disc and aid lower element for accurately locating said annular band relative to said cavities.

* * * * *